US006668935B1

(12) United States Patent
McLoughlin et al.

(10) Patent No.: US 6,668,935 B1
(45) Date of Patent: Dec. 30, 2003

(54) VALVE FOR USE IN WELLS

(75) Inventors: Eugene P. McLoughlin, Houston, TX (US); Scott A. Rubinstein, Alvin, TX (US); Ricardo Martinez, Houston, TX (US); Alexandre G.E. Kosmala, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 11 days.

(21) Appl. No.: 09/667,151

(22) Filed: Sep. 21, 2000

Related U.S. Application Data

(60) Provisional application No. 60/155,866, filed on Sep. 24, 1999.

(51) Int. Cl.[7] ..... E21B 34/10

(52) U.S. Cl. ..... 166/375; 166/320; 166/321; 166/386

(58) Field of Search ..... 166/320, 321, 166/332.4, 334.4, 375, 316, 386

(56) References Cited

U.S. PATENT DOCUMENTS

| | | | | | |
|---|---|---|---|---|---|
| 2,178,540 | A | * | 11/1939 | McNeese et al. | 166/142 |
| 3,693,732 | A | * | 9/1972 | Sabi | 166/91.1 |
| 4,134,454 | A | * | 1/1979 | Taylor | 137/629 |
| 4,270,569 | A | * | 6/1981 | Reay et al. | 137/514.7 |
| 4,403,659 | A | * | 9/1983 | Upchurch | 166/321 |
| 4,782,896 | A | | 11/1988 | Witten | |
| 4,979,561 | A | | 12/1990 | Szarka | |
| 5,156,207 | A | | 10/1992 | Haugen et al. | |
| 5,172,717 | A | | 12/1992 | Boyle et al. | |
| 5,211,241 | A | * | 5/1993 | Mashaw et al. | 166/320 |
| 5,263,683 | A | * | 11/1993 | Wong | 166/332.4 |
| 5,310,004 | A | | 5/1994 | Leismer | |
| 5,325,917 | A | | 7/1994 | Szarka | |
| 5,598,864 | A | * | 2/1997 | Johnston et al. | 137/68.16 |
| 5,826,652 | A | | 10/1998 | Tapp | |
| 5,921,528 | A | * | 7/1999 | McCray | 251/205 |
| 6,044,908 | A | * | 4/2000 | Wyatt | 166/332.4 |
| 6,065,541 | A | * | 5/2000 | Allen | 166/222 |
| 6,276,458 | B1 | * | 8/2001 | Malone et al. | 166/240 |

FOREIGN PATENT DOCUMENTS

| | | | |
|---|---|---|---|
| WO | WO 99/19602 | * | 4/1999 |

* cited by examiner

*Primary Examiner*—Hoang Dang
(74) *Attorney, Agent, or Firm*—Van Someren, P.C.; Jeffrey E. Griffin; Brigitte Jeffery Echols

(57) ABSTRACT

A valve assembly to control the intake of fluid. The valve assembly has a valve body and a valve choke disposed therein. The valve choke has a choke bore through the interior of the valve choke. The valve choke has a plurality of orifices to the choke bore spaced at intervals along the valve choke. A seal is disposed between the valve body and valve choke. The valve system is operable to position the valve choke so that the seal is positioned between the valve body and the valve choke at the intervals between the plurality of orifices.

7 Claims, 19 Drawing Sheets

VALVE FOR USE IN WELLS

This application claims priority based on Provisional Application No. 60/155,866, filed in the United States on Sep. 24, 1999.

BACKGROUND OF THE INVENTION

1. Field of the Invention

The present invention relates to the field of flow control. More specifically, the invention relates to a device and method for controlling the flow of fluids in a wellbore that, in one embodiment, provides for full tubing flow.

2. Background of the Related Art

The economic climate of the petroleum industry demands that oil companies continually improve their recovery systems to produce oil and gas more efficiently and economically from sources that are becoming increasingly difficult to exploit without increasing the cost to the consumer. One successful technique currently employed is the drilling of deviated wells, in which a number of horizontal wells are drilled from a central vertical borehole. In such wells, and in standard vertical wells, the well may pass through various hydrocarbon bearing zones or may extend through a single zone for a long distance. One method to increase the production of the well is to perforate the well in a number of different locations, either in the same hydrocarbon bearing zone or in different hydrocarbon bearing zones, and thereby increase the flow of hydrocarbons into the well.

One problem associated with producing from a well in this manner relates to the control of the flow of fluids from the well and to the management of the reservoir. For example, in a well producing from a number of separate zones (or from laterals in a multilateral well) in which one zone has a higher pressure than another zone, the higher pressure zone may produce into the lower pressure zone rather than to the surface. Similarly, in a horizontal well that extends through a single zone, perforations near the "heel" of the well, i.e., nearer the surface, may begin to produce water before those perforations near the "toe" of the well. The production of water near the heel reduces the overall production from the well. Likewise, gas coning may reduce the overall production from the well.

A manner of alleviating this problem is to insert a production tubing into the well, isolate each of the perforations or laterals with packers, and control the flow of fluids into or through the tubing. However, typical flow control systems provide for either on or off flow control with no provision for throttling of the flow. To fully control the reservoir and flow as needed to alleviate the above described problem, the flow is throttled. A number of devices have been developed or suggested to provide this throttling although each has certain drawbacks. Note that throttling may also be desired in wells having a single perforated production zone.

Specifically, the prior devices are typically either wireline retrievable valves, such as those that are set within the side pocket of a mandrel, or tubing retrievable valves that are affixed to the tubing string. The wireline retrievable valve has the advantage of retrieval and repair while providing effective flow control into the tubing without restricting the production bore. However, one drawback associated with the current wireline retrievable-type valves is that the valves cannot attain "full bore flow." An important consideration in developing a flow control system pertains to the size of the restriction created into the tubing. It is desirable to have full bore flow, meaning that the flow area through the valve when fully open should be at least as large as the flow area of the tubing so that the full capacity of the tubing may be used for production. Therefore, a system that provides full bore flow through the valve is desired.

One area of particular concern relating to downhole valves is the erosion caused by the combination of high flow rates, differential pressure and the properties of the fluids, which may contain solids, such as sand. Erosion of the tools results in premature failure of the valves.

A need remains for a flow control system that provides for full bore flow and for an efficient, reliable, erosion-resistant system that can withstand the caustic environment of a wellbore, including a deviated wellbore.

SUMMARY OF THE INVENTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

According to one aspect of the present invention, a valve assembly for use in a well is featured. The valve assembly comprises a valve body, a valve choke, and a sealing member. The valve body has a flow port. The valve choke has at least one orifice. The valve body and valve choke surround a hollow interior. The sealing member is located between the valve body and the valve choke. The valve assembly is operable to provide fluid flow through the flow port and at least one orifice to the hollow interior by positioning the at least one orifice on a first side of a seal formed by the sealing member. Additionally, the valve assembly is operable to prevent fluid communication between the flow port and the at least one orifice by positioning the at least one orifice on a second side of the seal.

According to another aspect of the present invention, a valve assembly for controlling the intake of wellbore fluids is featured. The valve assembly comprises a housing and a choke. The outer housing has a fluid inlet. The choke has an outer surface and a plurality of orifices through the outer surface. Each of the plurality of orifices is separated by a solid portion of the choke outer surface. The valve assembly is operable to position the seal relative to the choke so that the seal engages the choke a solid surface portion, rather than an orifice.

According to another aspect of the present invention, a method of operating a valve assembly is featured. The method comprises deploying a valve assembly having a choke with a plurality of holes through the choke and a sealing member into a wellbore. The method also comprises operating the valve assembly to move the choke incrementally between a plurality of positions to control fluid flow into the valve assembly from the wellbore. At each of the plurality of positions the sealing member is positioned against a solid surface portion of the choke.

According to another aspect of the present invention, a system for controlling fluid flow from a wellbore is featured. The system comprises a valve assembly disposed in the wellbore and tubing to convey fluid from the wellbore to the surface. The valve assembly comprises a valve body having a flow port, a valve choke having an orifice, and a seal disposed between the valve body and the valve choke. The valve assembly also comprises a drive mechanism. The drive mechanism is operable to position the valve choke relative to the seal. Additionally, the drive mechanism is operable to position the valve choke to a first position relative to the seal so that the orifice is in complete fluid communication with the wellbore and the hollow interior.

According to another aspect of the present invention, a protective device for an orifice within a wellbore valve assembly is featured. The protective device comprises an insert having a fluid flow path therethrough. The insert is sized for insertion into the orifice. Furthermore, the insert comprises an erosion resistant material.

According to another aspect of the present invention, a deformable sealing device for use in forming a seal between a valve choke and a valve body is featured. The deformable sealing device comprises a seal ring configured to selectively form a seal between the valve choke and the valve body. The seal comprises an erosion resistant material.

BRIEF DESCRIPTION OF THE DRAWINGS

The invention will hereafter be described with reference to the accompanying drawings, wherein like reference numerals denote like elements, and.

DESCRIPTION OF SPECIFIC EMBODIMENTS

One or more specific embodiments of the present invention will be described below. In an effort to provide a concise description of these embodiments, not all features of an actual implementation may be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As used herein, the terms "up" and "down"; "upper" and "lower"; "upwardly"and downwardly"; and other like terms indicating relative positions above or below a given point or element are used in this description to more clearly describe some embodiments of the invention. However, when applied to equipment and methods for use in wells that are deviated or horizontal, such terms may refer to a left to right or right to left relationship as appropriate.

Figure 1:
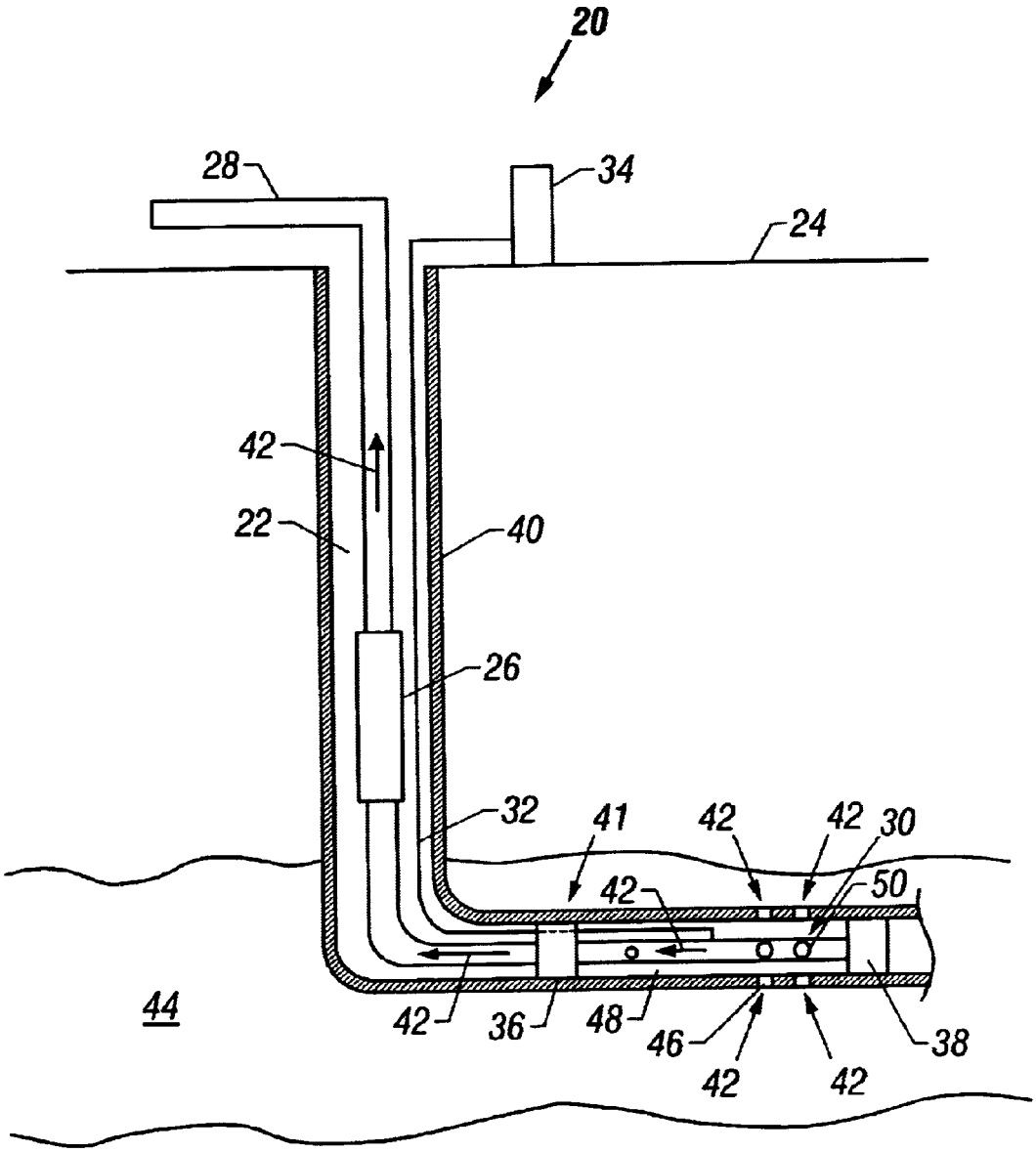
FIG. 1 is a front elevational view of a system for pumping fluids from a wellbore; according to an exemplary embodiment of the present invention.

Referring generally to FIG. 1, a system 20 for producing fluids from a wellbore 22 to the surface 24 is featured. In the illustrated embodiment, system 20 includes an electric submersible pumping system (ESP) 26, production tubing 28, a fluid intake valve assembly 30, a hydraulic control line 32, a hydraulic controller 34, a first packer 36, and a second packer 38. However, a pumping system need not be used. Fluid pressure may be sufficient to produce fluid to the surface without the use of a pumping system. As an additional measure, wellbore 22 is lined with casing 40.

In the illustrated embodiment, valve assembly 30 is disposed in a horizontal deviation 41 of wellbore 22. Valve assembly 30 is used to control the intake of fluid into system 20. Fluids, as referenced by arrows 42, flow from a geological formation 44 through perforations 46 in casing 40 into wellbore 22. First packer 36 and second packer 38 define a first region 48 within wellbore 22. Fluid 42 is drawn into system 20 from first region 48 through inlet ports 50 in valve assembly 30.

Valve assembly 30 is operable to control the size of the area though which fluid 42 may flow into valve assembly 30. In the illustrated embodiment, valve assembly 30 is operated by hydraulic pressure controlled from the surface 24 by a hydraulic controller 34. A control line 32 is used to apply hydraulic pressure to valve assembly 30 from hydraulic controller 34. Hydraulic controller 34 may be as simple as a pair of manually operated valves or as complex as a computer controlled system.

Figure 2:
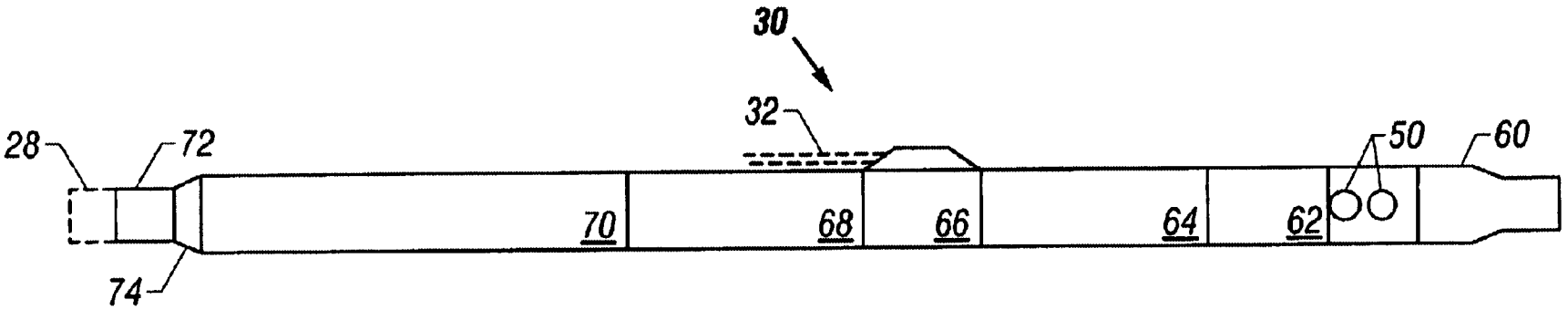
FIG. 2 is a front elevational view of a valve assembly, according to an exemplary embodiment of the present invention.

Referring generally to FIG. 2, an exemplary embodiment of valve assembly 30 is featured. Valve assembly 30 includes a lower housing 60, a choke housing 62, a hydraulic chamber housing 64, an indexer housing 66, a piston housing 68, and a nitrogen coil housing 70. In the illustrated embodiment, a plurality of fluid inlet ports 50 are provided in choke housing 62 so that fluid 42 may enter the interior of choke housing 62. Lower housing 60 may terminate valve assembly 30 or be used to fluidicly couple valve assembly 30 to a second valve assembly. Valve assembly 30 also includes an upper nipple 72 and a protective sleeve retainer 74 to couple the valve assembly to production tubing 28.

When valve assembly 30 is in the closed position, there is no fluid flow path for fluid 42 to be drawn into valve assembly 30 from wellbore 22. When valve assembly 30 is in an open position, ESP 26 will draw fluid 42 through the fluid inlet ports 50 into the interior of valve assembly 30 and on to the surface 24 through production tubing 28. Additionally, in this embodiment, valve assembly 30 provides "full bore" flow in the fully open position, i.e., the flow area though the orifices is at least as large as the flow area through production tubing 28. Valve assembly 30 also may be positioned to an intermediate position where fluid flow through valve assembly 30 will be throttled to less than full bore flow.

Figure 3A:
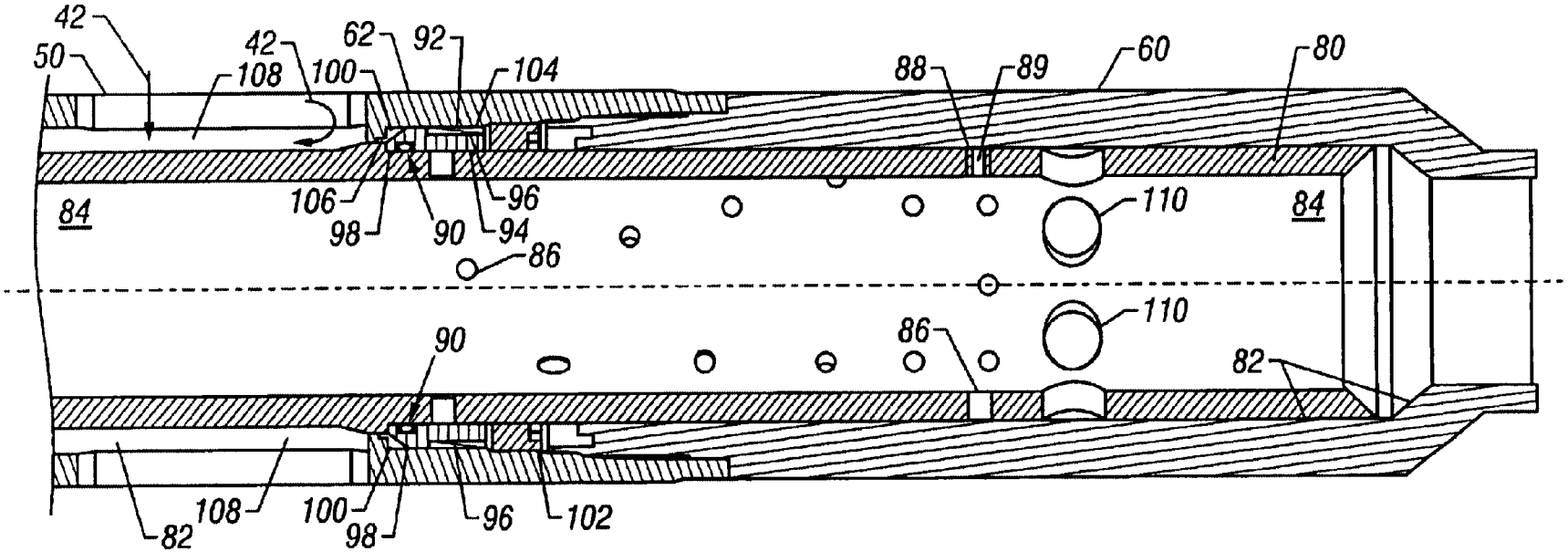
FIG. 3A is a cross-sectional view of a first portion of a valve assembly, according to an exemplary embodiment of the present invention.

Referring generally to FIG. 3A, valve assembly 30 utilizes a choke 80 housed within lower housing 60 and choke housing 62. Alternatively, choke housing 62 and inlet ports 50 could be disposed within choke 80. Lower housing 60 and choke housing 62 are generally tubular in shape and combine to form a valve bore 82. Valve bore 82 extends through valve assembly 30 from lower housing 60 to upper nipple 72. Choke 80 is slidably disposed within valve bore 82. Choke 80 has a choke bore 84 extending through the center. Choke 80 is configured with a plurality of orifices 86 to allow fluid to flow from the exterior of choke 80 into choke bore 84. When valve assembly 30 is in an open position, fluid is drawn through orifices 86 into choke bore 84, then to valve bore 82, and on to production tubing 28. When valve assembly 30 is in a closed position, no fluid is drawn into choke bore 84.

In the illustrated embodiment, fluid flow into choke bore 84 is controlled by positioning choke 80 within choke housing 62 so that fluid may either flow, or not flow, through some or all of the orifices 86. Alternatively, choke 80 may be disposed exterior to choke housing 62. Additionally, although the valve is shown with the holes in the choke 80 and the seal attached to the housing, other embodiments also are within the scope of the present invention. For example, the plurality of inlet orifices may be provided in the housing with a sleeve moveable to selectively uncover the inlet orifices. In such an embodiment, the seal is preferably attached to the sleeve to provide the necessary sealing between the orifices.

Figure 4:
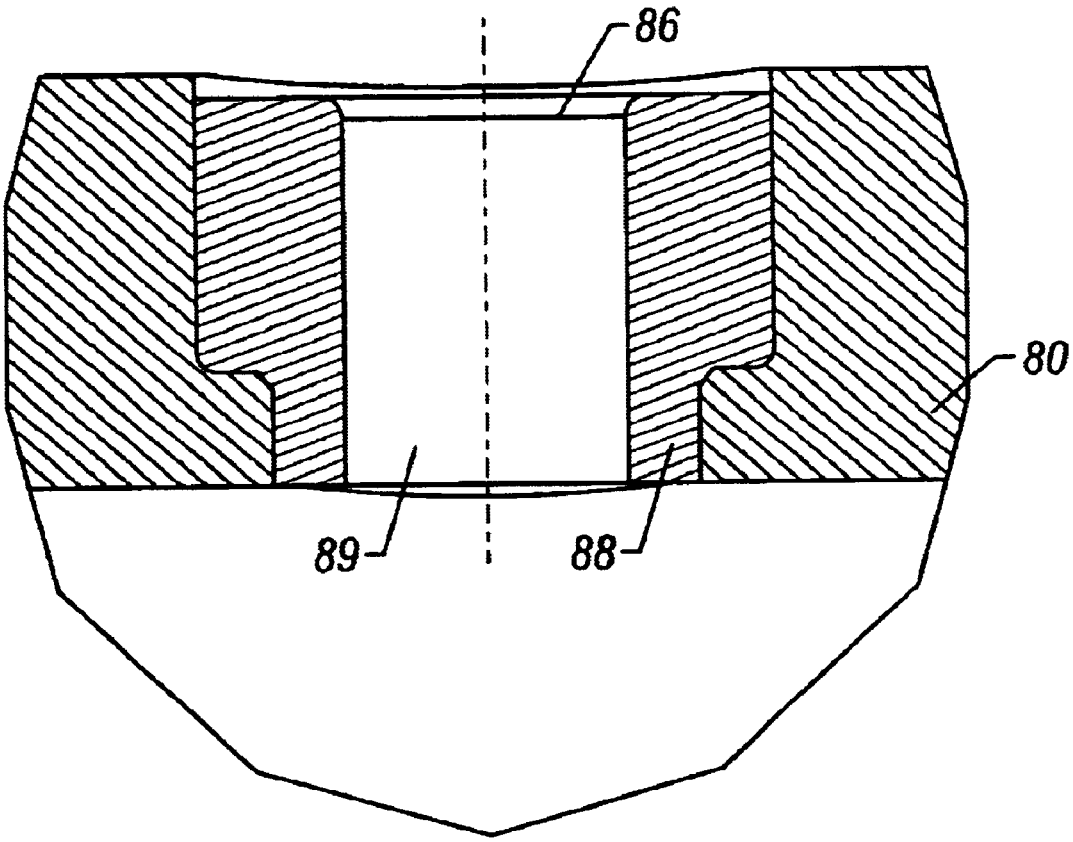
FIG. 4 is a cross-sectional view of an orifice and orifice insert, according to an exemplary embodiment of the present invention.

In the illustrated embodiment, each of the plurality of orifices 86 is generally circular. Additionally, in this embodiment each orifice 86, generally, has the same flow area. However, the size of orifices 86 may be varied. As best illustrated in FIG. 4, each of the plurality of orifices may have an insert 88 to line the orifice and prevent flow damage to the orifice and choke 80. Orifice insert 88 may be a separable device or a layer of material deposited on the orifice surface. Each insert 88 has a passageway 89 through the insert. Preferably, each orifice insert 88 is constructed from a hard, erosion-resistant material having a hardness of at least 1,200 knoops. Acceptable materials for the orifice insert 88 include polycrystalline diamond, vapor deposition diamond, ceramic, hardened steel, tungsten-carbide, and carbide. Alternatively, instead of using orifice inserts 88, choke 80 may be constructed of a hard, erosion-resistant material.

Referring again to FIG. 3A, fluid 42 is prevented by sliding seal 90 from flowing through orifices 86 into choke bore 84. Sliding seal 90 forms a seal between the inside surface 92 of choke housing 62 and the outside surface 94 of choke 80. Sliding seal 90 includes a primary seat 96 and a secondary seat 98. In the exemplary embodiment, primary seat 96 is formed of a hard, erosion-resistant material. Preferably, such material has a hardness of at least 1,200 knoops. Acceptable materials for primary seat 96 include polycrystalline diamond, vapor deposition diamond, ceramic, hardened steel, tungsten-carbide, and carbide. The secondary seat 98 may be formed from any of a number of deformable, erosion-resistant, plastic-like materials such as PEEK. Sliding seal 90 also includes a flow restrictor ring 100, a seat retainer 102, and a seat seal assembly 104.

Choke 80 includes a choke stop 106. Choke stop 106 is preferably an annular protrusion that extends radially outwardly from choke 80 into an annular gap 108 between choke 80 and choke housing 62. In the closed position of choke 80, choke 80 abuts primary seat 96. The sealing engagement between the primary seat 96 and choke stop 106 helps to seal against high pressure differential non-compressible fluid flow. The secondary seat 98 aids in the sealing engagement between choke stop 106 and primary seat 96. The sealing engagement between the plastic-like secondary seat 98 and choke stop 106 helps to seal against low pressure differential gas flow.

In the illustrated embodiment, valve assembly 30 allows fluid communication between the inlet ports 50 and those orifices 86 above sliding seal 90 and prohibits fluid communication between the fluid inlet ports 50 and those orifices 86 below sliding seal 90. In the illustrated embodiment, the number of orifices 86 above sliding seal 90 is established by hydraulically positioning choke 80 within choke housing 62.

Figure 5:
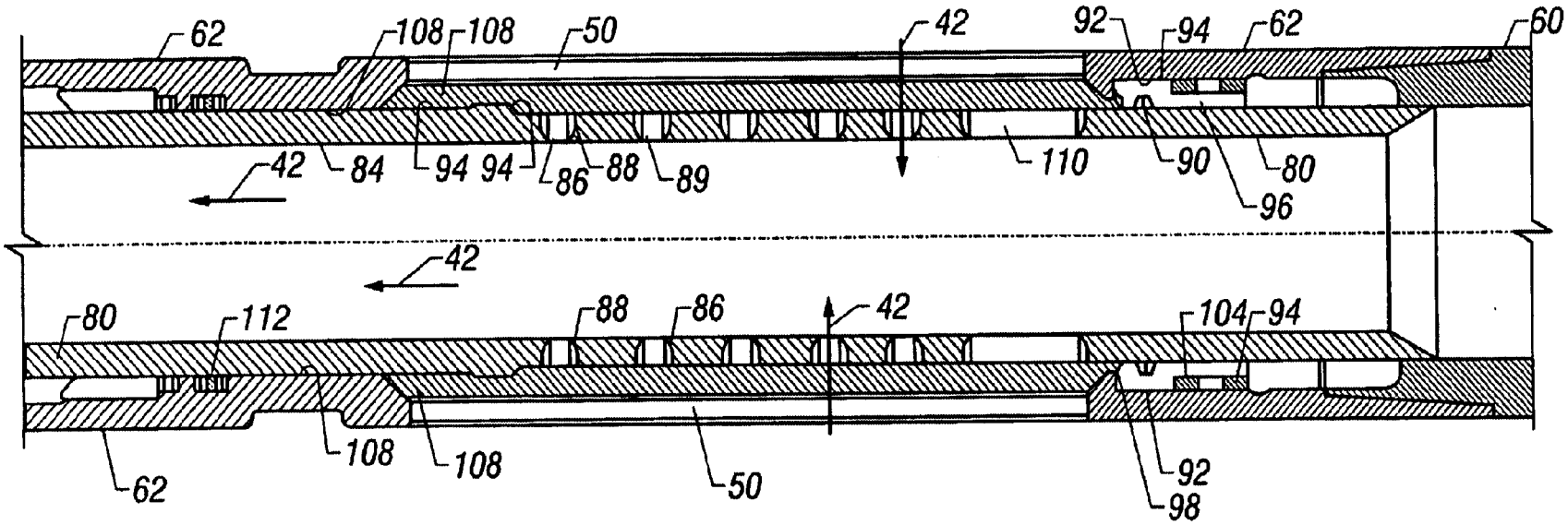
FIG. 5 is a cross-sectional view of a choke positioned in the fully open position, according to an exemplary embodiment of the present invention.

In the illustrated embodiment, choke 80 may be positioned at a fully closed position, a fully open position, or among several intermediate positions. As best illustrated in FIG. 5, in the fully open position of choke 80 fluid flows through all of the orifices. In the intermediate flow positions, fluid flows through at least one orifice 86. The position selected is determined by the desired flow characteristics of valve assembly 30. The number, size; and configuration of orifices 86 may be selected to produce a variety of different flow characteristics. The choke 80 and the orifices 86 are configured so that fluid flows through a different configuration of orifices 86 at each new intermediate position. By varying the configuration of orifices 86 at each intermediate position, the fluid flow area through the orifices may be varied and fluid flow may be throttled.

In the illustrated embodiment, a greater number of orifices 86 are placed in service at each new intermediate position from fully closed to fully open. However, the sequence may be varied to provide a larger flow area or a smaller flow area, or combinations of both. Additionally, choke 80 has several large diameter free flow orifices 110 that are placed in service to provide "full bore" flow when valve assembly 30 is in the fully open position. In "full bore" flow, the flow area of the plurality of orifices 86 and free flow orifices 110 is at least as large as the flow area through production tubing 28.

The orifices 86 are configured on choke 80 so that sliding seal 90 is not disposed over any of the orifices 86 when valve assembly 30 is at one of the intermediate positions or the fully open position. This might produce erosion damage to sliding seal 90. As an additional preventive measure, the orifices are configured so that each orifice is disposed at a sufficient distance from sliding seal 90 to either prevent or minimize erosion damage to sliding seal 90.

Figure 3B:
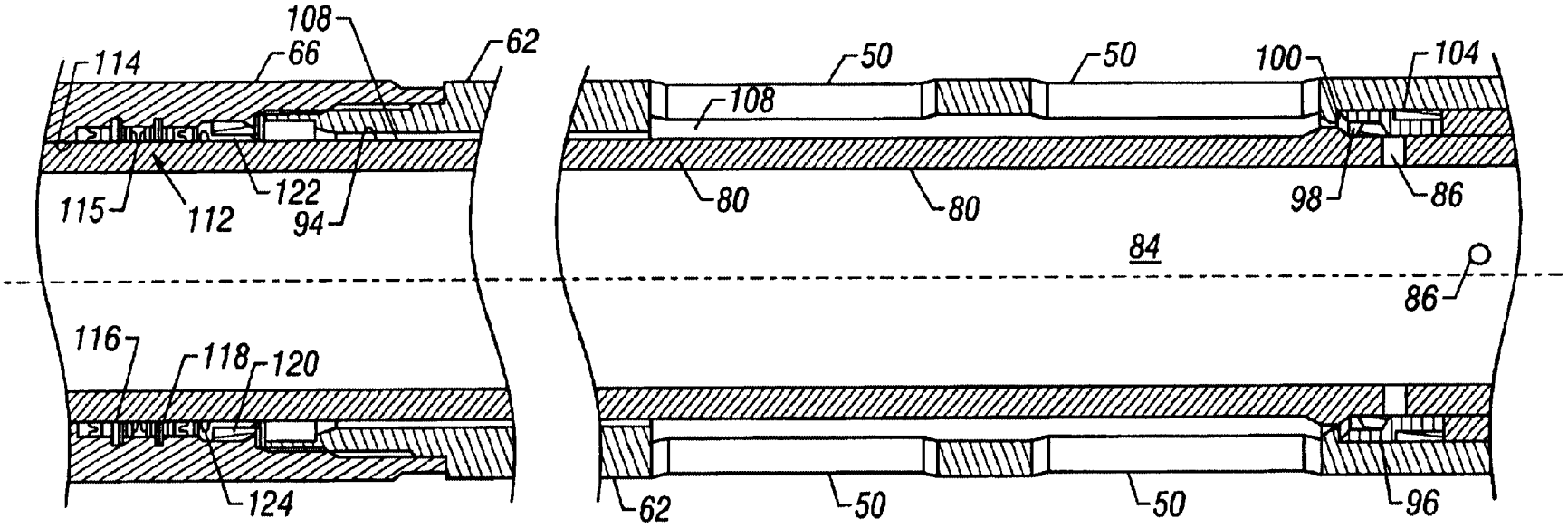
FIG. 3B is a cross-sectional view of a second portion of a valve assembly, according to an exemplary embodiment of the present invention.

Referring generally to FIG. 3B, a lower seal 112 prevents fluid flow up annular gap 108. Lower seal 112 forms a sliding seal between the inside surface 114 of hydraulic chamber housing 64 and the outside surface 94 of choke 80. Lower seal 112 utilizes a lower seal assembly 115, lower seal washer 116, a lower spiral retainer ring 118, a lower seal retainer ring 120, a lower seal scraper 122, and an O-ring 124.

Figure 3C:
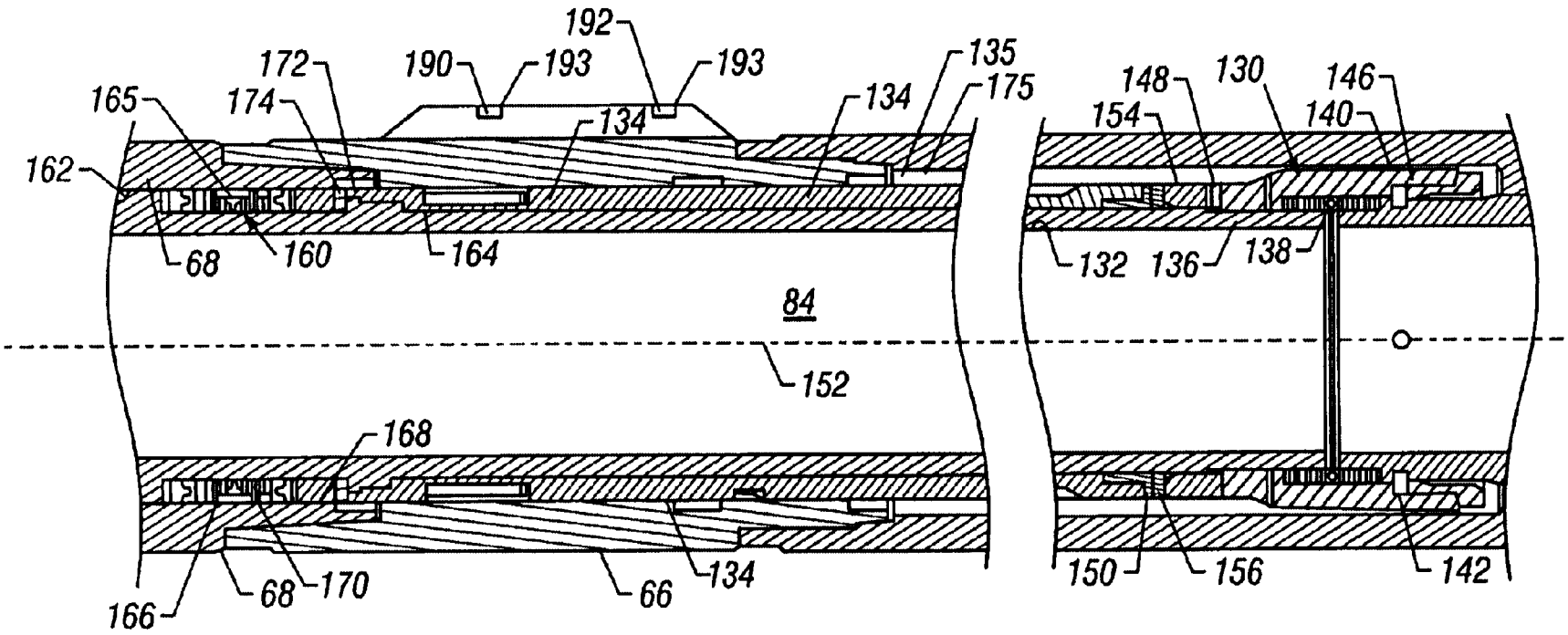
FIG. 3C is a cross-sectional view of a third portion of a valve assembly, according to an exemplary embodiment of the present invention.

Referring generally to FIG. 3C, a floating joint 130 is used to couple choke 80 to a piston 132. Piston 132 has a hollow interior that extends choke bore 84. Piston 132 is housed within, and secured to, an indexer 134. Indexer 134 is used to guide the movement of piston 132. Indexer 134 is, in turn, housed within indexer housing 66. A second annular gap 135 is formed between indexer 134 and indexer housing 66. The floating joint 130 utilizes a floating joint seal assembly 136, a floated joint spacer 138, a floated joint body piece 140, a floated joint split ring 142, a floated joint retainer 144, a first socket set screw 146, and a second socket set screw 148. A lower bearing 150 is provided between piston 132 and indexer 134 so that indexer 134 may rotate around piston 132. Indexer 134 is configured for rotation about a central axis 152 as piston 132 is moved linearly. Indexer 134 is coupled to floating joint 130 by an indexer retainer 154 and a thrust washer 156.

Lower seal 112 defines the lower end of second annular gap 135 and a piston seal 160 defines the upper end. Piston seal 160 is secured to piston 132 and forms a sliding seal between the inside surface 162 of piston housing 68 and the outside surface 164 of piston 132. Piston seal 160 utilizes a piston seal assembly 165, a piston seal washer 166, a piston seal retainer ring 168, and an upper spiral retainer ring 170. An upper bearing 172 is provided to cooperate with lower bearing 150 to allow rotation of indexer 134. A thrust washer 174 is disposed between upper bearing 172 and piston seal retainer ring 168.

Hydraulic fluid 175 occupies second annular gap 135. In this view, applying hydraulic pressure to hydraulic fluid 175 in annular gap 135 drives piston 132 to the left. An opposing force, such as a pressurized gas or spring, is used to drive piston 132 to the right. Indexer 134 controls the movement of indexer 134, and thus piston 132. In the preferred embodiment, indexer 134 enables choke 80 to be selectively positioned at various intermediate positions between the closed position and the fully open position, enabling valve assembly 30 to provide intermediate flow rates between fluid inlet ports 50 and choke bore 84.

Figure 6:
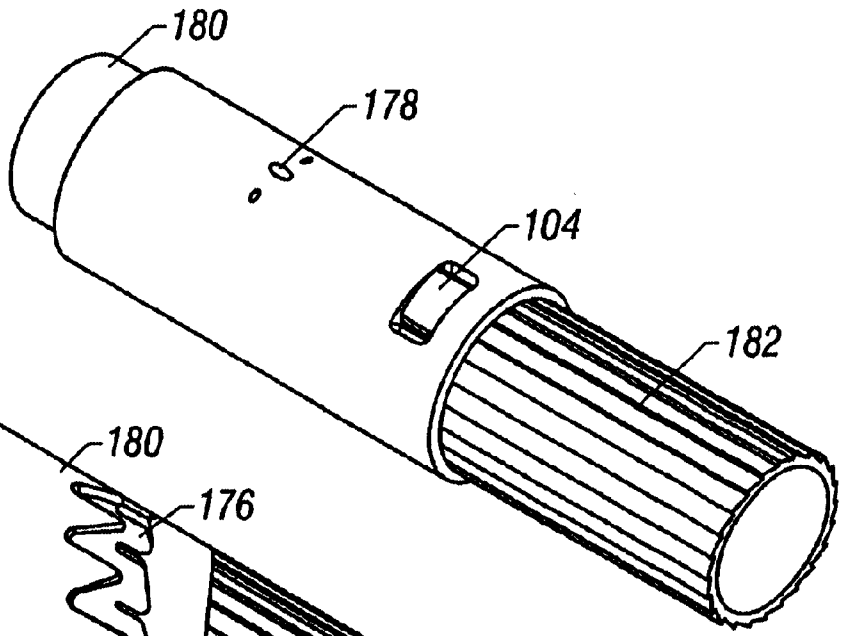
FIG. 6 is a perspective view of an indexer and indexer housing, according to an exemplary embodiment of the present invention.
Figure 6A:
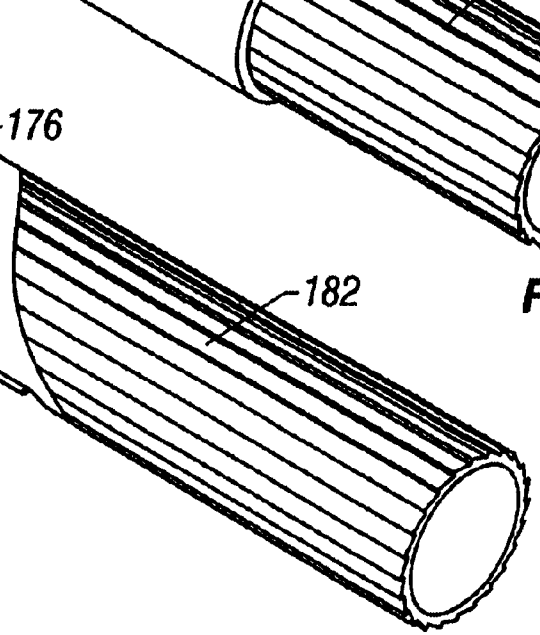
FIG. 6A is an exploded view of the indexer and indexer housing of FIG. 7.

As best illustrated in FIGS. 6 and 6A, indexer 134 includes a j-slot 176 that extends around the indexer. A stationary indexer pin 178 is inserted into j-slot 176. As piston 132 is driven up or down, its movement will be guided by indexer pin 178 acting on j-slot 176 of indexer 134.

J-slot 176 and indexer pin 174 cause indexer 134 to rotate about axis 152 as the valve assembly is shifted from one position to the next. Indexer 134 makes one complete revolution as valve assembly 30 transits from the closed position to the fully open position and back to the closed position. A portion of the outer surface 180 of indexer 134 is configured with a toothed surface 182. A latch 184, secured to indexer housing 66, is used with toothed surface 182 to ensure that indexer 134 rotates about axis 152 in only one direction. This ensures that j-slot 176 cooperates with indexer pin 178 to produce the desired motion of indexer 134.

Figure 6B:
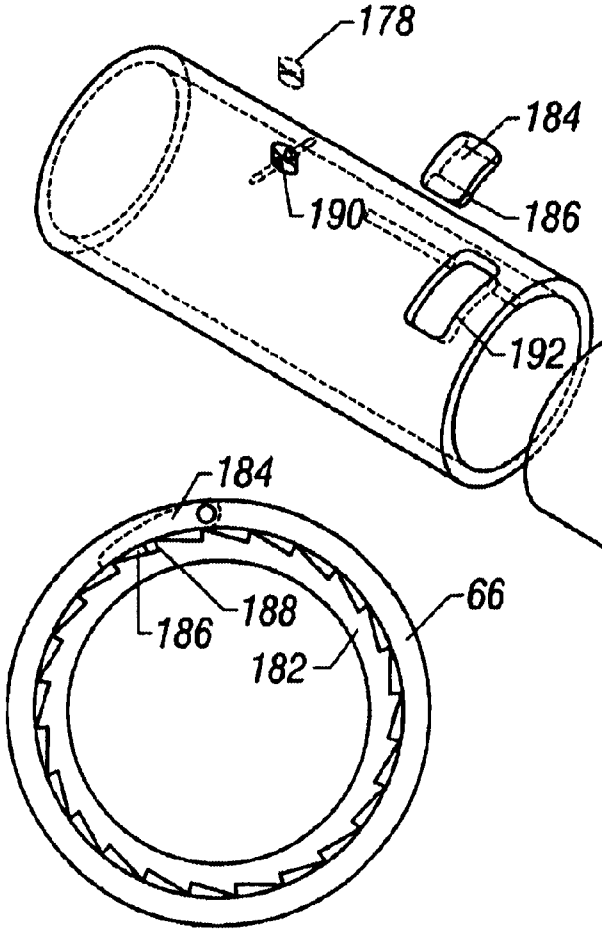
FIG. 6B is an end view of the indexer and indexer housing of FIG. 6.

As best illustrated in FIG. 6B, latch 184 has a tooth 186 and toothed surface 182 has a plurality of abutting surfaces 188. In this view, indexer 134 may only rotate clockwise. If indexer 134 is rotated counter-clockwise, catch 186 will contact one of the abutting surfaces 188 of toothed surface 182, preventing further motion of indexer 134 in the counter-clockwise direction. Indexer pin 178 is inserted through a first opening 190 in indexer housing 66 and latch 184 is inserted through a second opening 192 in indexer housing 66. As illustrated in FIG. 3C, a pair of keeper plates 193 are placed over first opening 190 and a second opening 192 in indexer housing 66.

Figure 3D:
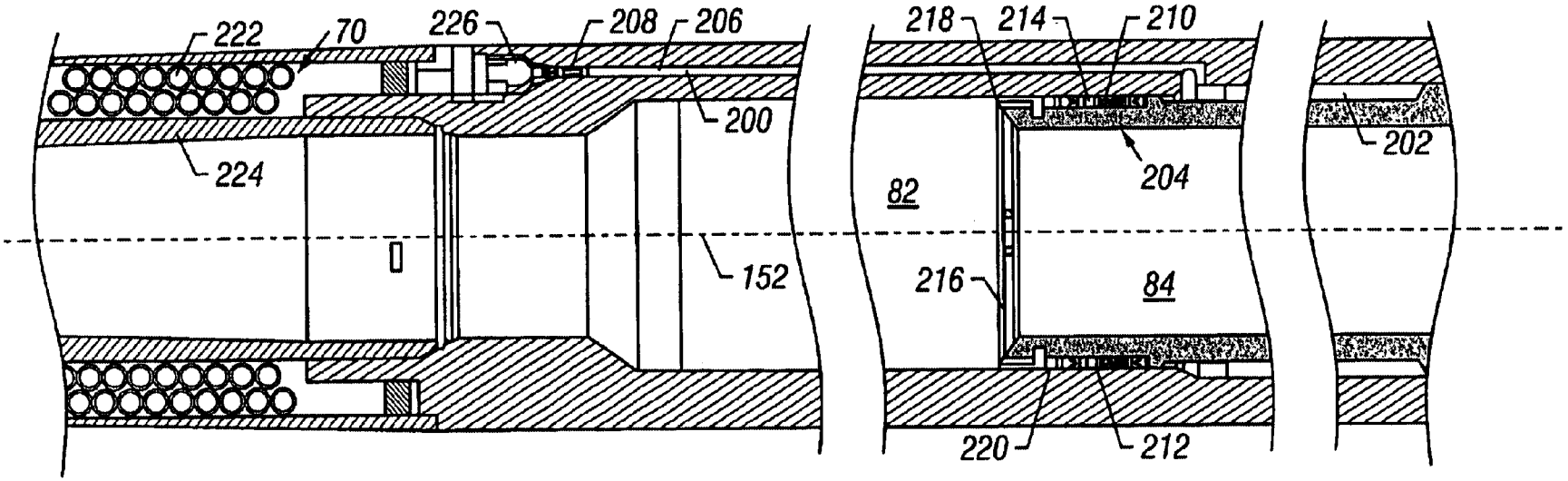
FIG. 3D is a cross-sectional view of a fourth portion of a valve assembly, according to an exemplary embodiment of the present invention.

Referring generally to FIG. 3D, pressurized nitrogen is used to provide the opposing force against the hydraulic pressure. Pressurized nitrogen 200 is stored in a pocket formed in piston housing 68. Another pressurized gas, such as air, also may be used. The pocket is defined by a third annular gap 202 formed between piston seal 160, an upper seal 204, and a supply line 206 extending from a check valve 208 to annular gap 202. Upper seal 204 includes an upper seal assembly 210, an upper seal washer 212, an upper spiral retainer ring 214, an upper seal retainer ring 216, an upper seal scraper 218, and an O-ring 220.

Figure 3E:
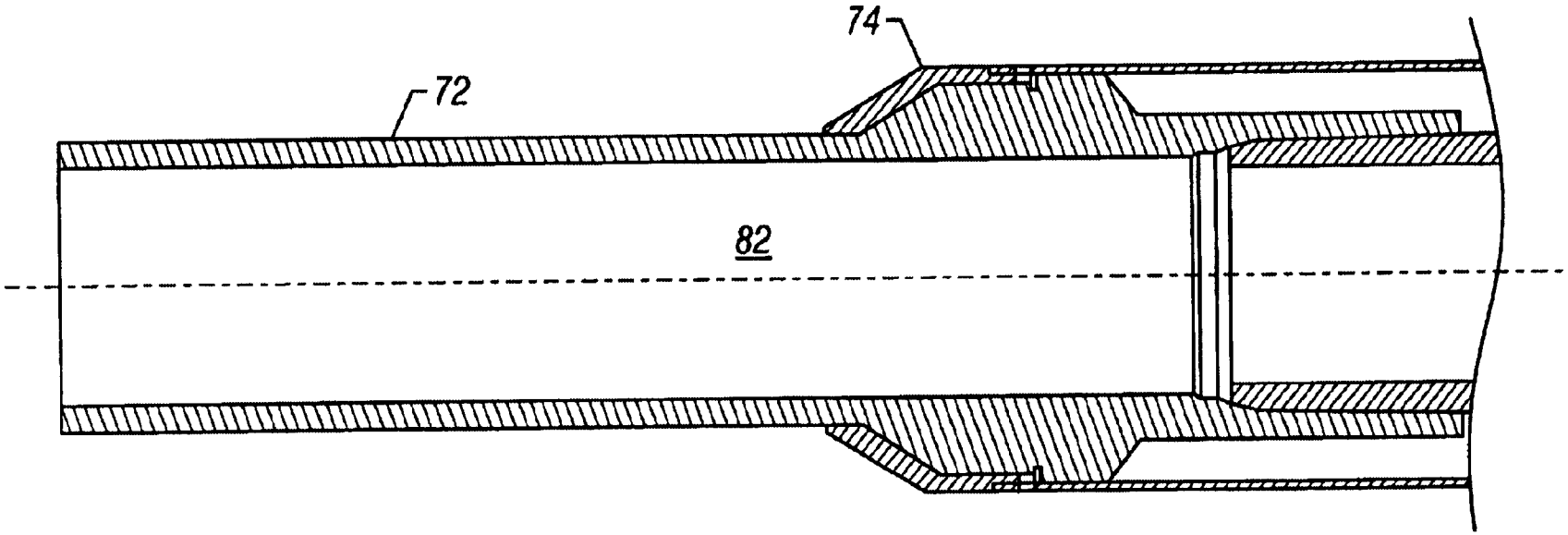
FIG. 3E is a cross-sectional view of a fifth portion of a valve assembly, according to an exemplary embodiment of the present invention.

A nitrogen coil 222 is used to supply pressurized nitrogen. Nitrogen coil 222 is housed within the nitrogen coil housing 70. Nitrogen coil 222 is wrapped around a mandrel 224 secured to piston housing 68 at one end and upper nipple 72 at the other end. A nitrogen port fitting 226 is provided to couple nitrogen from nitrogen coil 222 to nitrogen supply line 206. As illustrated in FIG. 3E, nitrogen coil housing 70 is coupled to production tubing 28 by upper nipple 72 and protective sleeve retainer 74.

Hydraulic pressure is applied from the surface between piston seal 160 and lower seal 112 to operate valve assembly 30. Nitrogen pressure supplied by nitrogen coil 222 is provided between piston seal 160 and upper seal 204. The nitrogen pressure on one side of piston seal 160 opposes the hydraulic pressure on the other side of piston seal 160. The system is configured so that when hydraulic pressure is applied from the surface it overcomes the nitrogen pressure and drives piston 132 to the left. When hydraulic pressure is vented, the nitrogen pressure drives piston 132 to the right.

Figure 7A:
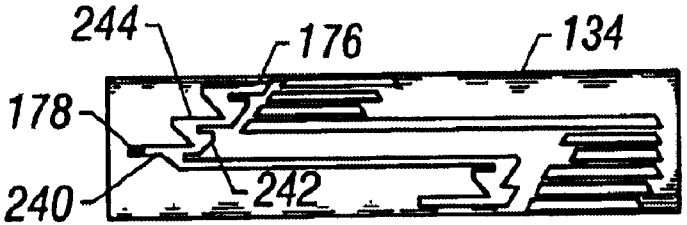
FIG. 7A is a top view of an indexer, illustrating the orientation of a j-slot and an indexer pin for a valve assembly in the closed position, according to an exemplary embodiment of the present invention.
Figure 7:
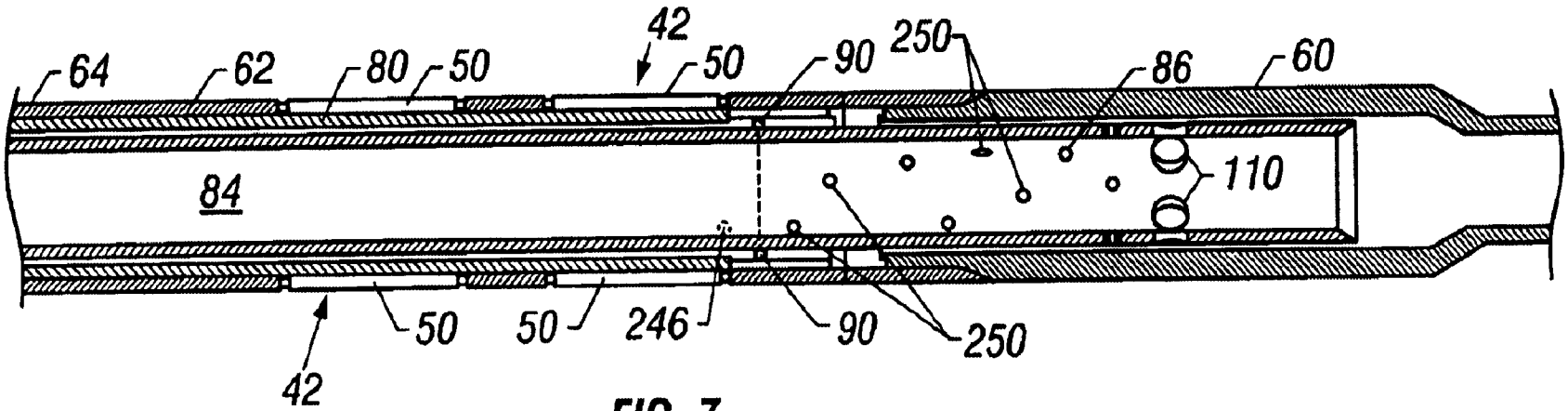
FIG. 7 is a cross sectional view of a portion of a valve assembly, illustrating a choke in the closed position, according to an exemplary embodiment of the present invention.
Figure 8A:
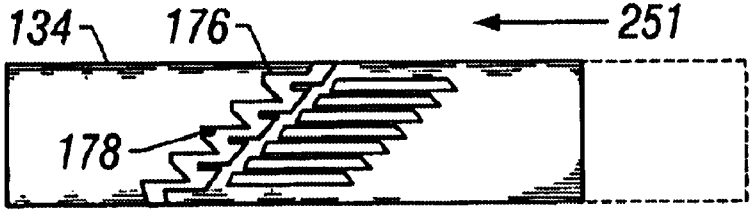
FIG. 8A is a top view of an indexer, illustrating the orientation of a j-slot and an indexer pin for a valve assembly in an intermediate position, according to an exemplary embodiment of the present invention.
Figure 8:
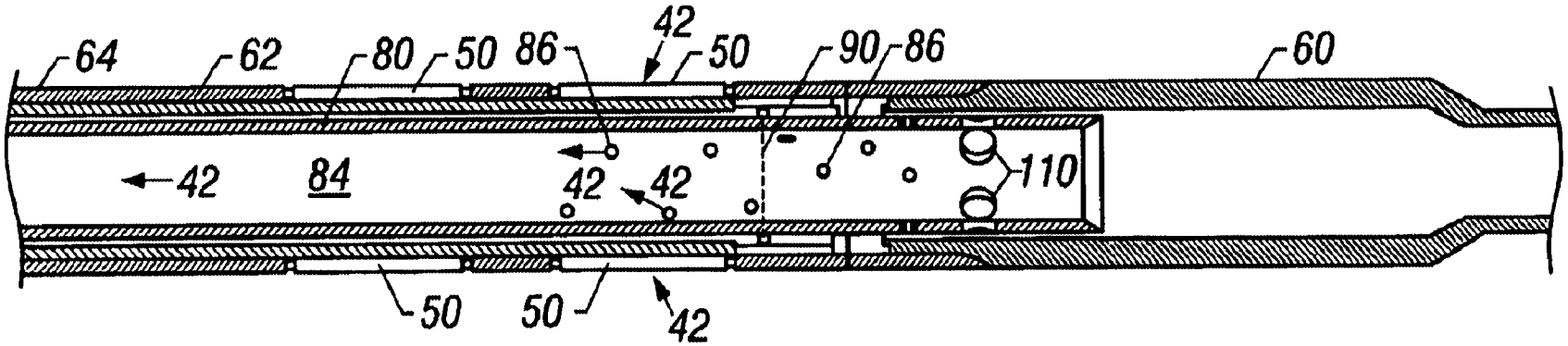
FIG. 8 is a cross sectional view of a portion of a valve assembly, illustrating a choke in an intermediate position, according to an exemplary embodiment of the present invention.
Figure 9A:
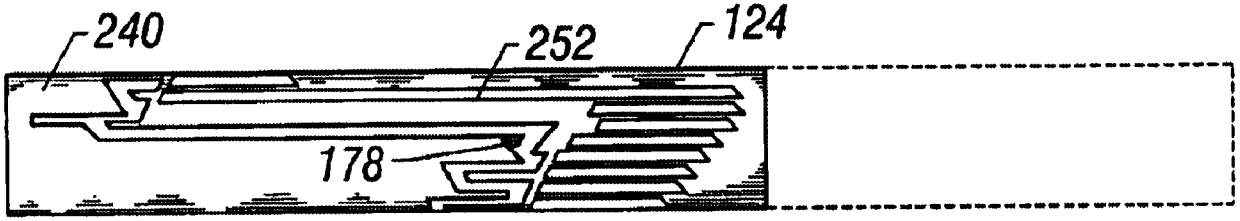
FIG. 9A is a top view of an indexer, illustrating the orientation of a j-slot and an indexer pin for a valve assembly in the fully-open position, according to an exemplary embodiment of the present invention.
Figure 9:
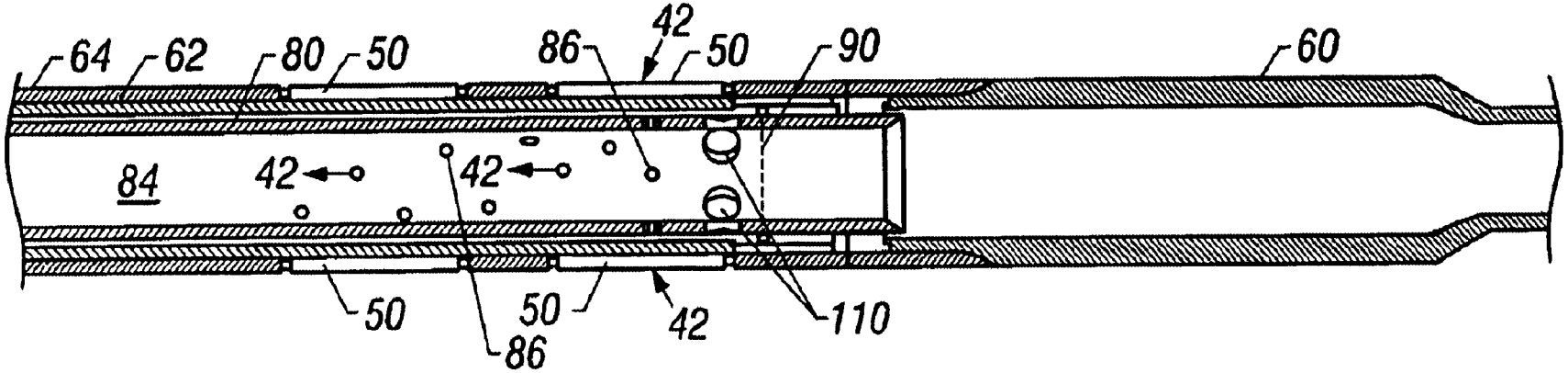
FIG. 9 is a cross sectional view of a portion of a valve assembly, illustrating a choke in the fully-open position, according to an exemplary embodiment of the present invention.

Referring generally to FIGS. 7–9, indexer 134, j-slot 176, and indexer pin 178 combine to establish incremental linear movement of piston 132, and choke 80. In the illustrated embodiment, valve assembly 30 has ten different incremental linear positions: a closed position, eight intermediate positions, and a fully open position. The number of positions, however, is arbitrary. To move from one position to the next, hydraulic pressure is first applied to drive piston 132 to the left. Hydraulic pressure is then vented, allowing the opposing force to drive piston 132 to the right. The overall displacement of piston 132, left or right, is established by j-slot 176.

FIG. 7 illustrates valve assembly 30 in the closed position. Fluid 42 is prevented from flowing into choke bore 84 through any of the orifices 86 by sliding seal 90. As illustrated in FIG. 7A, with hydraulic fluid vented to atmosphere, nitrogen pressure forces piston 132 to the right positioning indexer 134 against indexer pin 178 in a first slot position 240 in j-slot 176.

To move to the next incremental linear position, hydraulic pressure is applied to drive piston 132 and indexer 134 to the left. J-slot 176 and indexer pin 178 cooperate to direct the movement of indexer 134. Hydraulic pressure drives piston 132 such that indexer 134 is positioned against indexer pin 178 at a second slot position 242 in j-slot 176, stopping further linear movement of piston 132. As piston 132 is driven linearly, indexer 134 is rotated about axis 152 by j-slot 176.

Hydraulic pressure is then vented to atmosphere to complete the movement to the next position. The nitrogen pressure forces piston 132 and indexer 134 to the right. J-slot 176 and indexer pin 178 cooperate to direct the movement of indexer 134, such that indexer 134 is positioned against indexer pin 178 at a third position 244 in j-slot 176. Third position 244 is the first intermediate position of valve assembly 30. In this position, a first set of orifices 246 is positioned beyond sliding seal 90 and fluid 42 flows through the first set of orifices 246 into choke bore 84.

The axial distance between first position 240 and third position 244 of j-slot 176 represents the linear displacement of choke 80 from the closed position to the first intermediate position. In the illustrated embodiment, j-slot 176 is configured so that the axial displacement is constant from one position to the next. Furthermore, choke 80 is configured so that the axial displacement is the same distance as the distance 250 between each set of orifices 86. Thus, one additional orifice, or set of orifices, may provide flow at each new intermediate position.

FIGS. 8 and 8A represent valve assembly 30 at the fifth intermediate position. Five sets of orifices, shown in solid black, provide flow paths through choke 80 into choke bore 84. Each set of orifices is configured so that at each position of valve assembly 30, the set of orifices closest to sliding seal 90 is at a sufficient distance from sliding seal 90 to prevent, or minimize, flow damage to sliding seal 90.

FIG. 8A illustrates the linear motion of indexer 134 in relation to indexer pin 178. Indexer 134 is displaced to the left, as referenced by arrow 251, from the closed position of FIG. 8A, shown in dashed lines.

FIGS. 9 and 9A represent valve assembly 30 in the fully-open position. All orifices 86, including free flow orifices 110, are illustrated providing fluid flow paths into choke bore 84. To return valve assembly 30 to the closed position, valve assembly 30 is operated in the same manner as if positioning valve assembly 30 to a more open position, hydraulic pressure is applied and then vented. During venting, nitrogen pressure drives piston 132 and indexer 134 back to the closed position, as shown in dashed lines, through a long slot portion 252.

Figure 10:
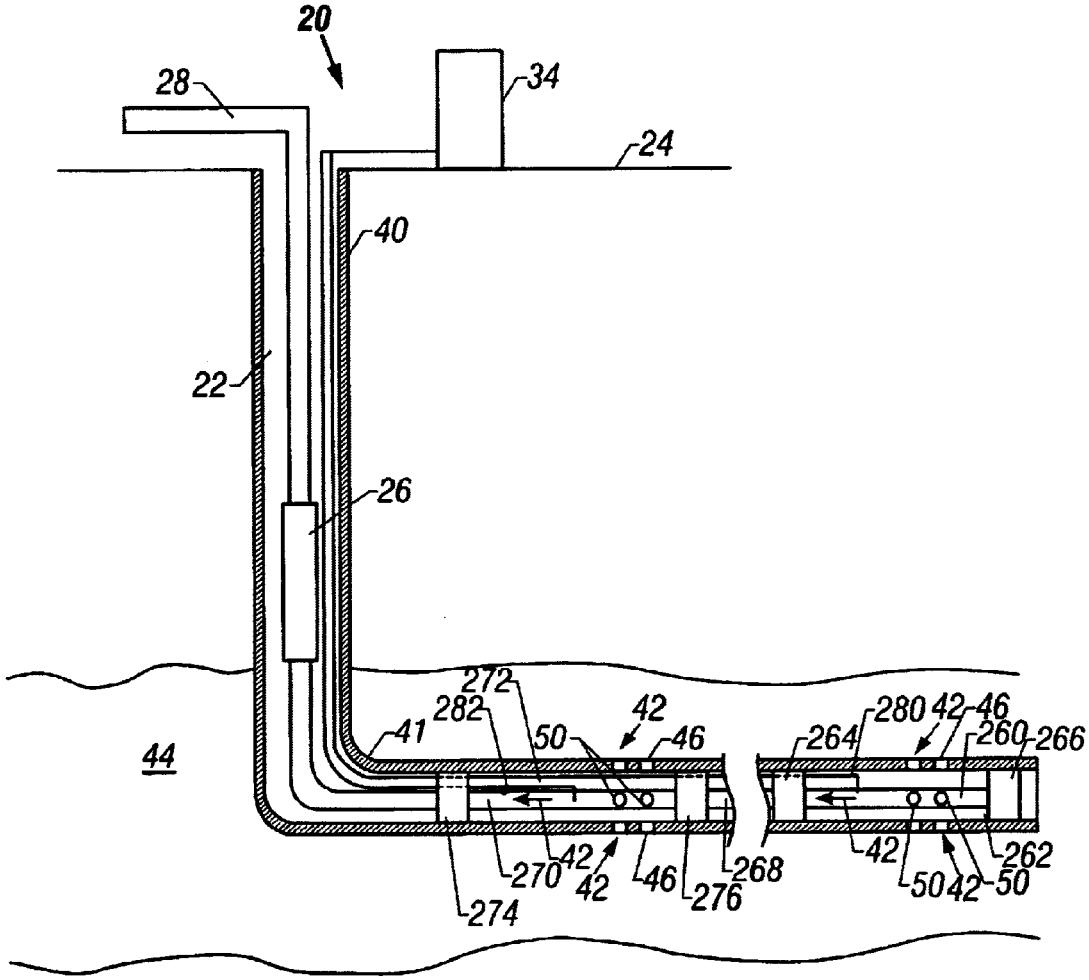
FIG. 10 is a front elevational view of a pumping system using two valve assemblies to withdraw fluids from two regions of a deviated wellbore, according to an alternative embodiment of the present invention.

Referring generally to FIG. 10, multiple valve assemblies may be utilized to draw fluids from two different regions of a wellbore through a common production tubing line. Different regions of wellbores my have different flow characteristics, such as fluid pressure. In the illustrated embodiment, the choke bores of two valve assemblies are coupled together fluidicly in series. Each valve assembly is independently controlled to allow each valve assembly to be configured for the flow characteristics of the corresponding region of the wellbore. Thus, one valve assembly in a lower fluid pressure region may be fully open while the second valve assembly in a higher pressure region may be throttled. Thus, allowing production from both regions through a single system of production tubing.

In the illustrated embodiment, a first valve assembly 260 is disposed in a first region 262 of a wellbore 22, defined by a first packer 264 and a second packer 266. First valve assembly 260 is coupled by tubing 268 to a second valve assembly-270. Second valve assembly 270 is disposed in a second region 272 of a wellbore 22, defined by a third packer 274 and a fourth packer 276. Second valve assembly 270 is, in turn, coupled to the surface. First valve assembly 260 is operated by a first control line 280 and second valve assembly 270 is operated by a second control line 282. First valve assembly 260 and second valve assembly 270 may be operated independently to provide the desired flow characteristics from the first and second regions of wellbore 22.

Figure 11:
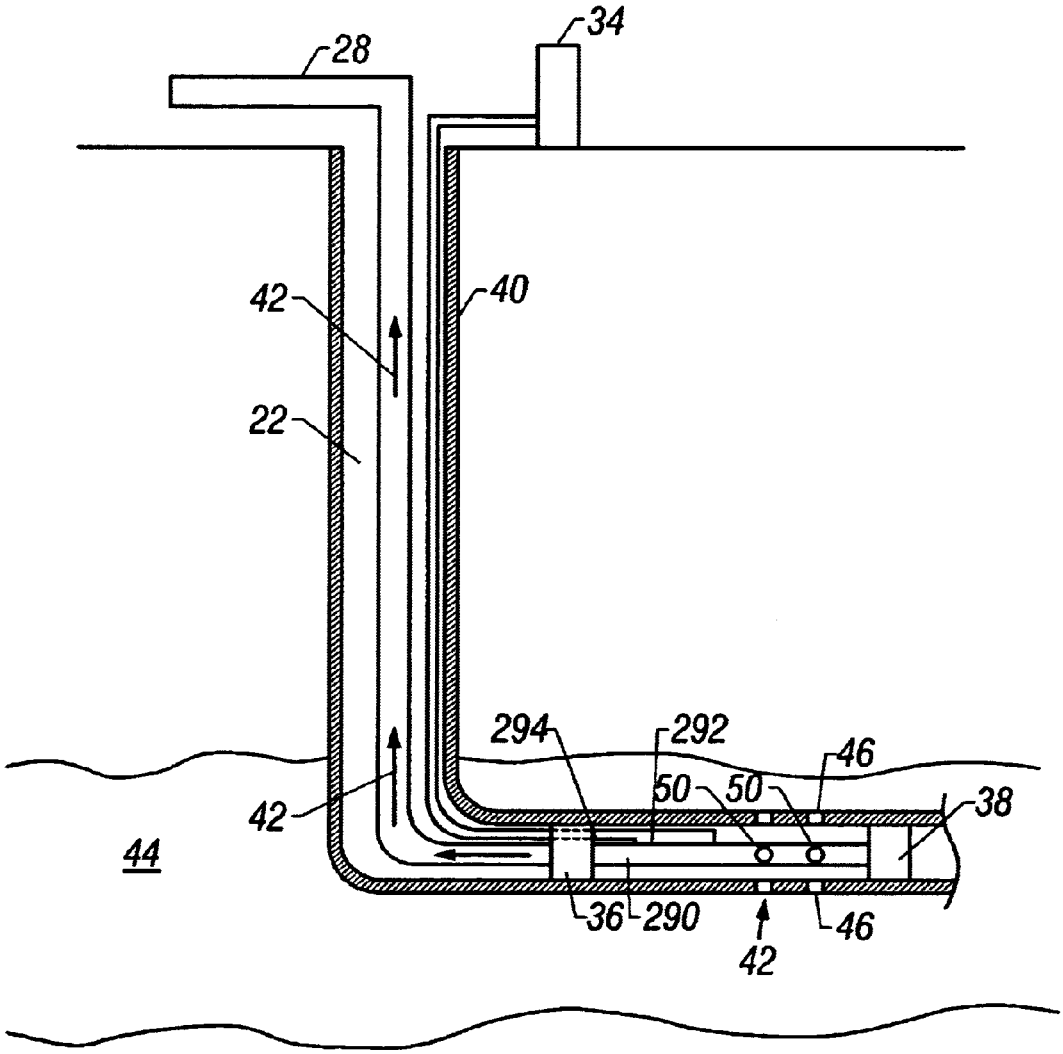
FIG. 11 is a front elevational view of a pumping system using two hydraulic control lines to operate a valve assembly, according to an alternative embodiment of the present invention.

Referring generally to FIG. 11, in an alternative embodiment, two control lines from the surface, rather than a single control line and nitrogen pressure, may be used to operate a valve assembly. In the illustrated embodiment, valve assembly 290 uses a first control line 292 and a second control line 294 to drive piston 132. Differential pressures between the two control lines is used to drive piston 132 in both directions, rather than using an opposing force, such as a pressurized gas or spring.

Figure 12:
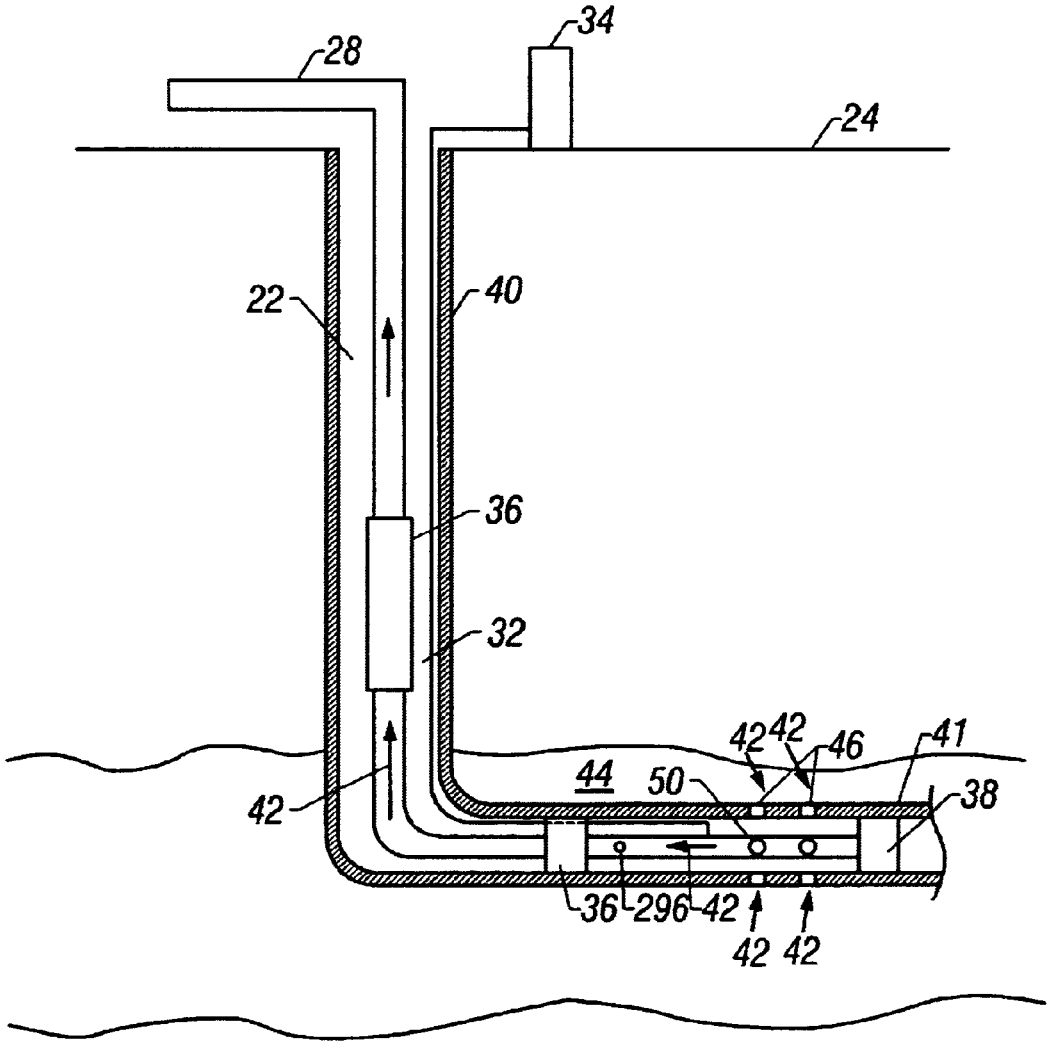
FIG. 12 is a front elevational view of a pumping system using the differential pressure between a hydraulic control line and wellbore pressure to operate a valve assembly, according to an alternative embodiment of the present invention.

Referring generally to FIG. 12, in a similar manner, the differential pressure between hydraulic pressure applied from the surface and the wellbore pressure may be used to drive the piston. In the illustrated embodiment, wellbore pressure is applied to the interior of valve assembly 30 via a diaphragm 296.

Figure 13:
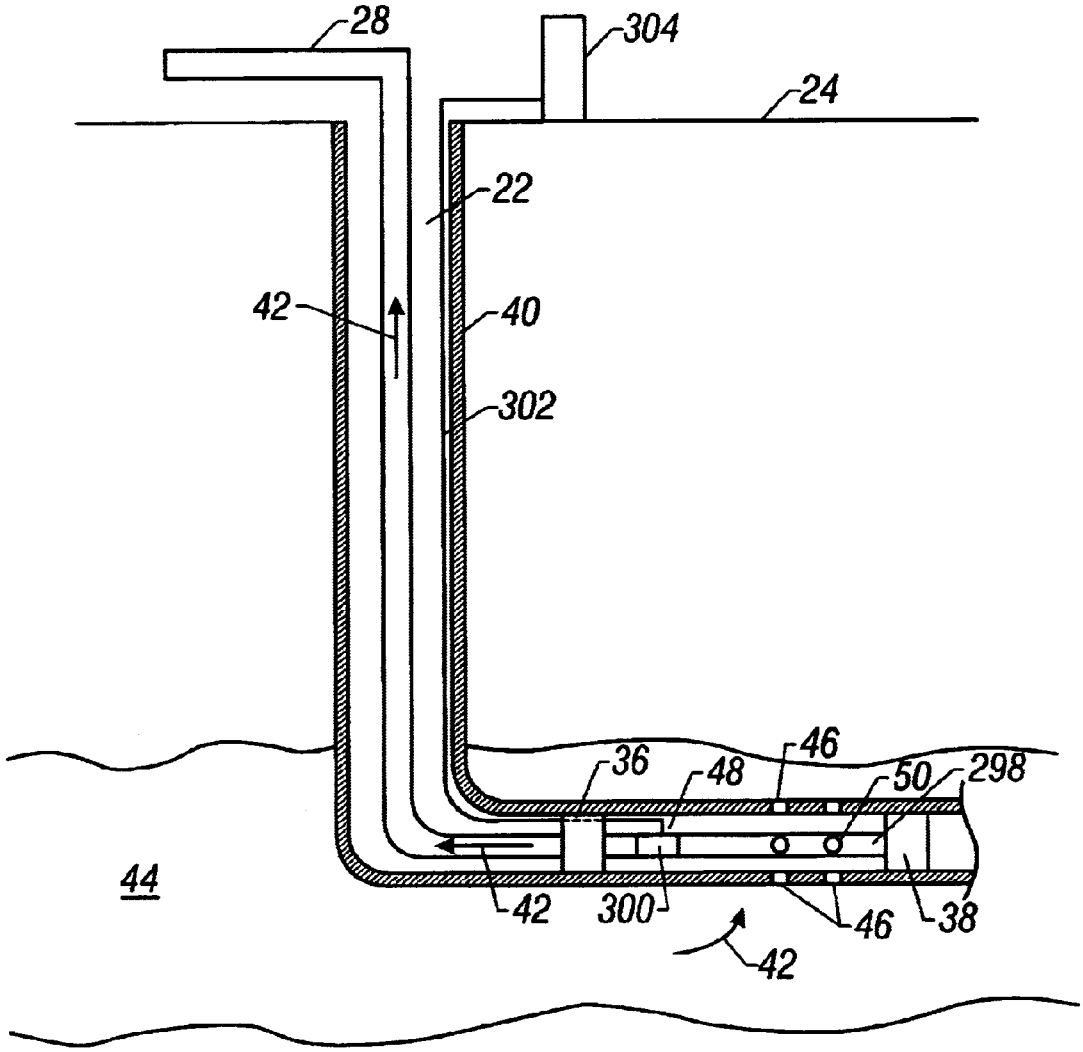
FIG. 13 is a front elevational view of a pumping system using an electric motor to operate a valve assembly, according to an alternative embodiment of the present invention.

Referring generally to FIG. 13, rather than hydraulic pressure, a submersible electric motor 300 may be used to position a choke in relation to an outer housing, or vice versa. In the illustrated embodiment, a valve assembly 298 is drivingly coupled to submersible electric motor 300 to position choke 80. The submersible electric motor 300 is supplied with electrical power by a power cable 302 extending from an electrical controller 304 at the surface.

Figure 14:
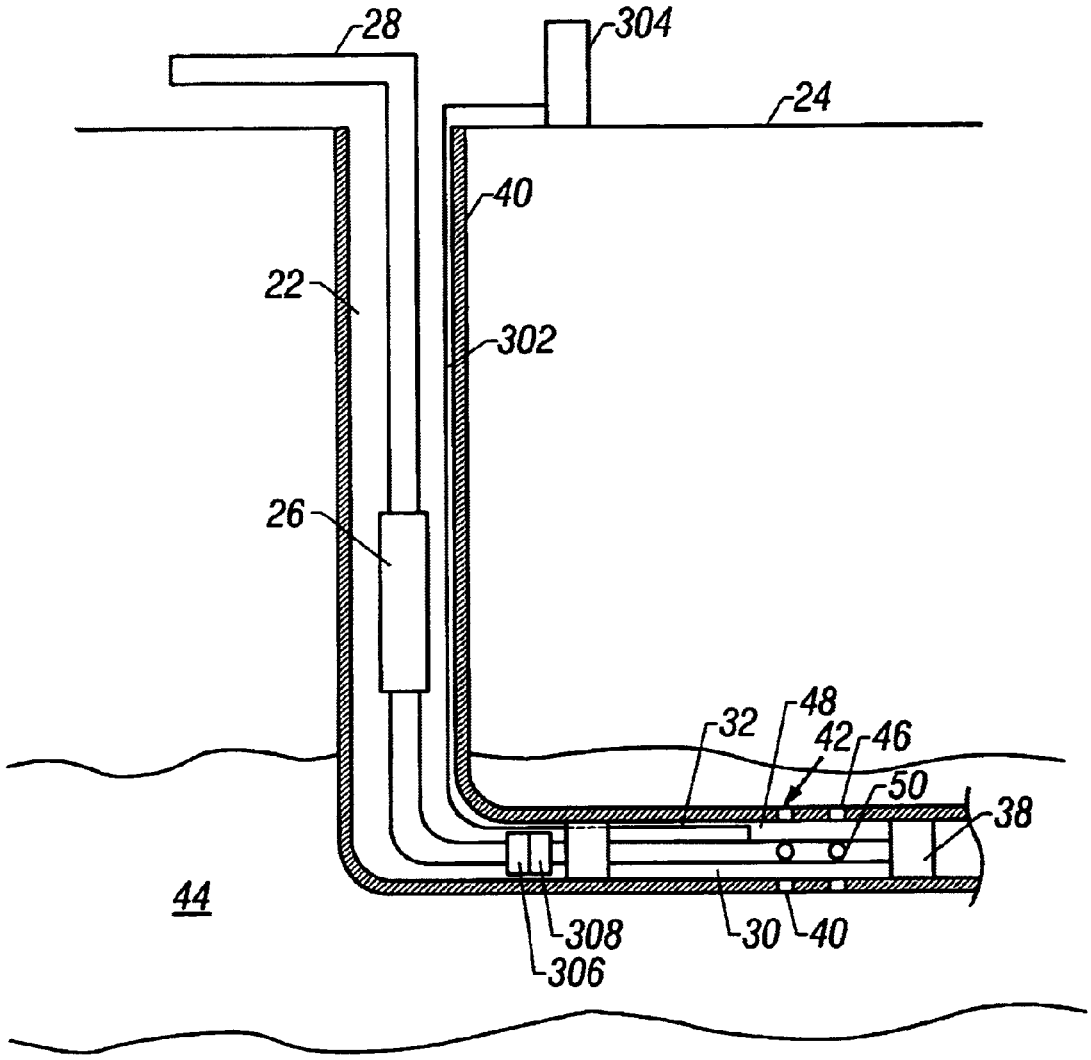
FIG. 14 is a front elevational view of a pumping system using a submersible electric pump to provide hydraulic pressure to operate a valve assembly, according to an alternative embodiment of the present invention.

Referring generally to FIG. 14, alternatively, a submersible electric motor 306 may be used to drive a submersible pump 308. The submersible pump 308 may be used to supply the hydraulic pressure to operate valve assembly 30.

Figure 15:
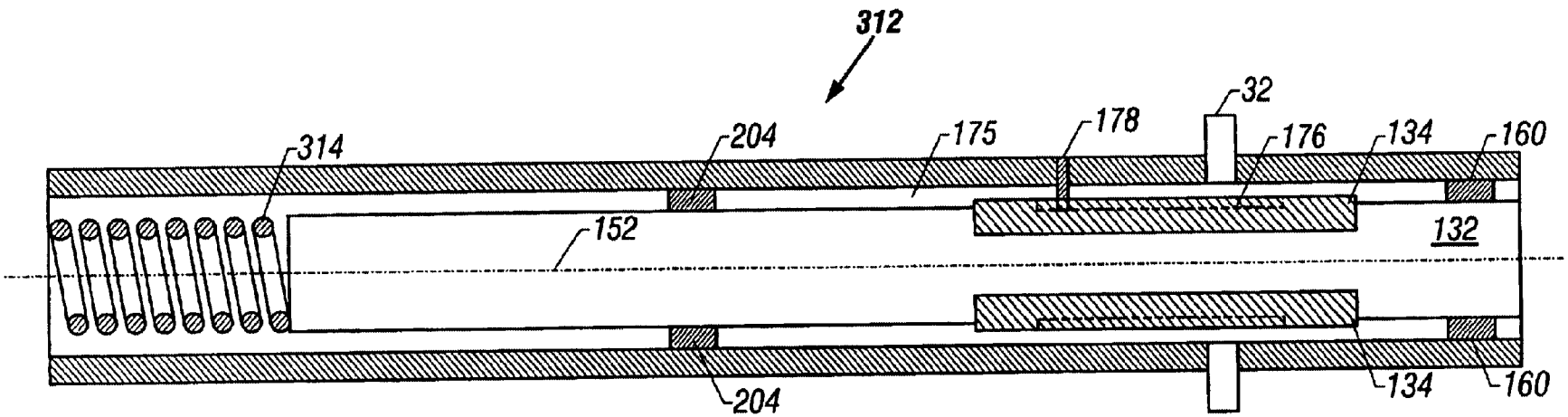
FIG. 15 is a cross-sectional view of a valve assembly using hydraulic fluid pressure and a spring to operate a valve assembly, according to an alternative embodiment of the present invention.

Referring generally to FIG. 15, an alternative valve assembly 312 may use a spring 314, rather than pressurized gas to oppose hydraulic pressure.

It will be understood that the foregoing description is of a preferred embodiment of this invention, and that the invention is not limited to the specific forms shown. For example, a variety of different configurations of orifices may be can be used to provide desired flow characteristics. Furthermore, a variety of different j-slot configurations may be used to direct movement of a choke. Additionally, the valve assemblies may be used in pumping systems other than electric submersible pumping systems. Also, the valve assemblies may be disposed in wellbores other than deviated wellbores. These and other modifications may be made in the design and arrangement of the elements without departing from the scope of the invention as expressed in the appended claims.

What is claimed is:

1. A method of operating a valve assembly, comprising:

forming a valve assembly having an outer housing and an inner housing, a scaling device therebetween, and a plurality of flow passages in at least one of the inner housing and the outer housing;

deploying the valve assembly into a wellbore;

routing an independent hydraulic control line along the wellbore to the valve assembly; and operating the valve assembly via hydraulic input through the independent hydraulic control line to selectively establish the relative position of the inner housing and the outer housing to expose a desired number of flow passages to fluid flow therethrough, wherein operating the valve assembly comprises engaging a deformable seal with a choke stop when the valve assembly is in a closed position.

2. The method as recited in claim 1, wherein forming comprises configuring a flow passage with a generally circular shape.

3. The method as recited in claim 2, wherein forming comprises configuring a flow passage with a protective insert.

4. The method as recited in claim 3, wherein forming comprise configuring a protective insert with a material having a hardness of at least 1,200 knoops.

5. The method as recited in claim 3, wherein forming comprises configuring a protective insert with tungsten carbide.

6. The method as recited in claim 3, wherein forming comprises configuring one of the inner housing and outer housing with a material having a hardness of at least 1,200 knoops.

7. The method as recited in claim 1, wherein forming comprises configuring the deformable seal with PEEK.

* * * * *

UNITED STATES PATENT AND TRADEMARK OFFICE

CERTIFICATE OF CORRECTION

PATENT NO. : 6,668,935 B1
DATED : December 30, 2003
INVENTOR(S) : Eugene P. McLoughlin et al.

It is certified that error appears in the above-identified patent and that said Letters Patent is hereby corrected as shown below:

Title page,
Item [54], Title, delete "VALVE" and insert -- VALVES --.

Column 11,
Line 15, delete "scaling" and insert -- sealing --.

Signed and Sealed this

Twenty-second Day of June, 2004

JON W. DUDAS
*Acting Director of the United States Patent and Trademark Office*